US007752945B2

(12) United States Patent
Bouligny, Jr.

(10) Patent No.: US 7,752,945 B2
(45) Date of Patent: Jul. 13, 2010

(54) SPRAG TOOL FOR TORQUING PIPE CONNECTIONS

(75) Inventor: Vernon Joseph Bouligny, Jr., New Iberia, LA (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 0 days.

(21) Appl. No.: 11/853,133

(22) Filed: Sep. 11, 2007

(65) Prior Publication Data

US 2009/0065223 A1 Mar. 12, 2009

(51) Int. Cl.
*B25B 13/50* (2006.01)
*E21B 19/16* (2006.01)

(52) U.S. Cl. ..... 81/57.33; 166/379

(58) Field of Classification Search ..... 81/57.33; 192/41 A, 45.1; 166/77.51, 379
See application file for complete search history.

(56) References Cited

U.S. PATENT DOCUMENTS

| | | | | | |
|---|---|---|---|---|---|
| 1,924,579 | A * | 8/1933 | Waterhouse | 81/3.4 |
| 2,707,038 | A * | 4/1955 | Szady | 192/41 A |
| 2,845,159 | A * | 7/1958 | Stephenson | 192/45.2 |
| 3,311,204 | A * | 3/1967 | Barnard | 192/41 A |
| 3,324,980 | A * | 6/1967 | Wade et al. | 192/45.1 |
| 3,543,895 | A * | 12/1970 | Klees | 192/45.1 |
| 3,946,843 | A * | 3/1976 | Downs | 192/45.1 |
| 4,347,920 | A * | 9/1982 | Bordes | 192/41 A |
| 4,762,187 | A * | 8/1988 | Haney | 175/171 |
| 5,451,084 | A * | 9/1995 | Jansch | 294/1.1 |
| 6,732,822 | B2 * | 5/2004 | Slack et al. | 175/423 |
| 7,128,161 | B2 * | 10/2006 | Pietras | 166/379 |
| 7,231,984 | B2 * | 6/2007 | Jaensch | 166/380 |
| 7,353,880 | B2 * | 4/2008 | Pietras | 166/379 |
| 7,445,050 | B2 * | 11/2008 | Kuttel et al. | 166/380 |
| 2001/0042625 | A1 * | 11/2001 | Appleton | 166/379 |
| 2005/0051343 | A1 * | 3/2005 | Pietras et al. | 166/380 |
| 2005/0269105 | A1 * | 12/2005 | Pietras | 166/379 |

* cited by examiner

*Primary Examiner*—David B Thomas
(74) *Attorney, Agent, or Firm*—Patrick K. Steele; Streets & Steele

(57) ABSTRACT

A pipe torquing sprag tool comprises one or more elastomeric sprags supported on a sprag support in an arrangement lying generally in a plane that is generally perpendicular to the axis of the rotatable sprag support. Each sprag has a solid, uninterrupted side and an interrupted side, and each sprag reacts to a lateral force in the general direction tangential to the surface of the sprag support and applied near the top of the sprag to bend the elastomeric sprag either toward the interrupted side to at least partially lean, fold or collapse, or towards the substantially uninterrupted side for being deformed to a generally compressed and non-compliant configuration for gripping. The sprag tool of the present invention may comprise a sprag support for positioning an external arrangement of sprags for being inserted into the bore of an add-on pipe segment. Alternately, the sprag tool of the present invention may comprise a sprag support for positioning an internal arrangement of sprags for being received over the end of an add-on pipe segment.

39 Claims, 6 Drawing Sheets

SPRAG TOOL FOR TORQUING PIPE CONNECTIONS

BACKGROUND

1. Field of Invention

The present invention relates to threaded oilfield tubulars. The present invention is directed to a tool for applying torque and rotation to an add-on pipe segment to make up or break out a threaded pipe connection or to rotate a pipe string. More specifically, the present invention is directed to a tool having one or more elastomeric sprags oriented on the tool for engaging and rotating an add-on pipe segment in a first rotational direction, but not in the opposite rotational direction. Additional sprags may be disposed on a separate portion of the tool for selectively providing for the capacity to rotate an add-on pipe segment in the opposite direction.

2. Description of the Related Art

Conventional power tongs are machines used on a rig to grip the exterior surface of an add-on pipe segment and rotate the add-on pipe segment about its axis to threadably make-up a connection between the add-on pipe segment and an aligned pipe string. The power tong generally has a throat through which the add-on pipe segment may be introduced between gripping jaws of the power tong. The gripping jaws are pivotally securable to a gripping jaw retainer that supports the jaws in position to grip, rotate and torque the add-on pipe segment by powered rotation of a surrounding ring gear. The ring gear may be rotatable using hydraulically-powered pinion gears to make up the threaded connection. After the threaded connection is torqued, a conventional power tong must generally be moved back away from well center for subsequent well operations. Conventional power tongs may be movably disposed on a track or in a groove that provides for automated advancement to and retraction from well center.

A power tong may cooperate with an elevator that kicks out from well center to secure to and position an add-on pipe segment for being joined to the pipe string. Elevators may be suspended from a vertically movable top drive or a block using a pair of elongate bails. After an add-on pipe segment is joined to the proximal end of the pipe string, the elevator may be used to support the pipe string within the borehole so that the spider may disengage and the lengthened pipe string may be further installed in the borehole by lowering the elevator and the pipe string through the disengaged spider. This process may be repeated until the pipe string reaches a desired length.

Conventional power tongs are generally large machines that consume a large portion of space on the rig floor, and some rigs may need to be retrofitted to accommodate conventional power tongs that operate on tracks or in grooves on the rig floor. Conventional power tongs may obstruct the view on the rig floor and often cause unwanted marks on the exterior of the add-on pipe segment and/or the pipe string. Conventional power tongs may present an obstruction on rigs equipped with elevators that kick out from well center to support and position add-on pipe segments at well center for being joined into the pipe string.

Other power tongs may comprise tools that internally grip the add-on pipe segment. Internally gripping power tongs, which may include casing running tools, often employ complex mechanisms for deployment of pipe gripping jaws. Actively deployable gripping jaws may deploy by operation of cams, cylinders or axially movable mandrels. These mechanisms result in additional cost, weight and maintenance, and often require a source of external power for deployment and retraction of gripping jaws to engage and release an add-on pipe segment, respectively.

What is needed is a method of rotating and torquing an add-on pipe segment to make up a threaded connection to a pipe string that utilizes substantially less rig floor space than a conventional power tong. What is needed is a power tong that can rotate and torque an add-on pipe segment using a top drive. What is needed is a power tong that can internally or externally engage and apply torque to an add-on pipe segment for making up or breaking out a threaded connection, thereby eliminating the cost, weight and maintenance of more complex actuated gripping jaws, and avoiding the need for coupling the tool to a source of power for engaging or retracting the tool. What is needed is a power tong that cooperates with elevators that kick out from well center to secure to and position add-on pipe segments at well center for being joined into the pipe string. What is needed is a tool for gripping and rotating an add-on pipe segment that does not mark or scar the pipe wall, and that does not cause damage to the threads that form the connection upon insertion of the tool into the bore of the add-on pipe segment.

SUMMARY OF THE PRESENT INVENTION

The present invention satisfies some or all of the above-referenced needs and others. The present invention is directed to a sprag tool for gripping and applying torque and rotation to an add-on pipe segment upon powered rotation of the sprag tool about its axis in a first direction.

The sprag tool of the present invention may provide a ratchet-like function that is achieved by strategically shaping the sprags that are disposed on the sprag tool. Each sprag may be shaped to grip the wall of the add-on pipe segment when the sprag is moved relative to the wall in a first direction, but to slip along the wall of the add-on pipe segment when the sprag is moved relative to the wall in a second direction. In one embodiment of the present invention, a sprag tool comprises a plurality of sprags formed using an elastomeric material and having a base, a top portion, an interrupted side and a substantially uninterrupted side. The sprag is generally securable to a sprag support at its base so that the top portion extends generally radially outwardly from the surface of the sprag support. The interrupted side of the sprag may comprise a gap, a recess, a hole, a notch or void, or a plurality of these features, to permit the sprag to compliantly lean, fold or collapse in response to the application of a generally lateral force near the top portion of the sprag and in the direction of the generally interrupted side.

The opposite side of the sprag is substantially uninterrupted so that the sprag deforms to a generally compressed and non-compliant configuration in response to the application of a generally lateral force near the top portion of the sprag and in the direction of the substantially uninterrupted side of the sprag by movement of the sprag support and the sprag relative to the contacted wall of the add-on pipe segment. The generally non-compliant mode of deformation of the sprag results in substantial compression of the sprag between the sprag support at its base and the wall of the add-on pipe segment at its top portion, and the compression of the sprag between these two surfaces causes the sprag to be forcibly urged against the wall of the add-on pipe segment, thereby substantially increasing the frictional grip of the elastomeric sprag on the wall of the add-on pipe segment.

Consequently, a sprag tool comprising an arrangement of angularly distributed sprags disposed on the exterior of a generally cylindrical sprag support that is inserted into the interior bore of an add-on pipe segment will not grip or turn the add-on pipe segment with much torque when the sprag tool is rotated on its axis in a direction that causes the sprags to engage the interior wall of the add-on pipe segment and the resulting force on the top portion of each sprag causes it to lean, fold or collapse toward its interrupted side. However, the same sprag tool will frictionally grip the interior bore of the add-on pipe segment, and rotate and torque the add-on pipe segment, when the sprag tool is rotated on its axis in the reverse direction that causes the sprags to engage the interior wall of the add-on pipe segment in a manner that produces a lateral force applied near the top portion of each sprag that causes the sprag to deform toward the substantially uninterrupted side and to assume a generally compressed configuration between the sprag support and the wall of the add-on pipe segment. The relatively great force applied to the interior wall of the add-on pipe segment as a result of the compression of the sprag between the sprag support and the wall of the add-on pipe segment enhances frictional contact that is multiplied by the number of sprags in the arrangement that engage and contact the interior bore of the add-on pipe segment.

Similarly, the sprag tool of the present invention may easily be adapted for gripping and rotating an add-on pipe segment by contacting the exterior wall. A sprag tool comprising an arrangement of angularly distributed sprags disposed on the interior bore of a generally cylindrical sprag support that is receivable over the end of a relatively smaller diameter add-on pipe segment will not grip or turn the add-on pipe segment with much torque when the sprag tool is rotated on its axis in a direction that causes each sprag to lean, fold or collapse toward its interrupted side. However, the same externally-gripping sprag tool will frictionally grip the exterior wall of an add-on pipe segment, and it will rotate and torque the add-on pipe segment, if the resulting lateral force on each sprag causes the sprag to deform toward the substantially uninterrupted side and to deform to the generally compressed configuration. The great force applied by each sprag to the exterior wall of the add-on pipe segment as a result of the compression of the sprag provides enhanced frictional contact that is multiplied by the number of sprags in the arrangement that contact the exterior bore of the add-on pipe segment.

One embodiment of the sprag tool of the present invention comprises sprags secured to the sprag support using adhesives. Another embodiment of the sprag tool of the present invention comprises sprags formed with a fastener that is releasably securable to a sprag support so that the sprags may be releasably installed on the sprag support. Yet another embodiment of the present invention comprises a sprag support having a plurality of radially outwardly protruding or inwardly protruding sprag stems, clips or retainers for securing sprags to the sprag support. In one embodiment, the sprags are installed on the sprag stems, clips or retainers when they are formed. In yet another embodiment the sprags are installed on the sprag support by being fitted into holes, apertures, grooves or channels within the sprag support. In yet another embodiment, a plurality of sprags may be coupled one to others to form a band or ring that is securable to a sprag support using fasteners, clamps or other known structures for securing a ring or band onto or within a generally cylindrical structure.

The foregoing and other objects, features and advantages of the invention will be apparent from the following more particular description of a preferred embodiment of the invention, as illustrated in the accompanying drawings wherein like reference numbers represent like parts of the invention.

DETAILED DESCRIPTION OF THE PREFERRED EMBODIMENT

Figure 1:
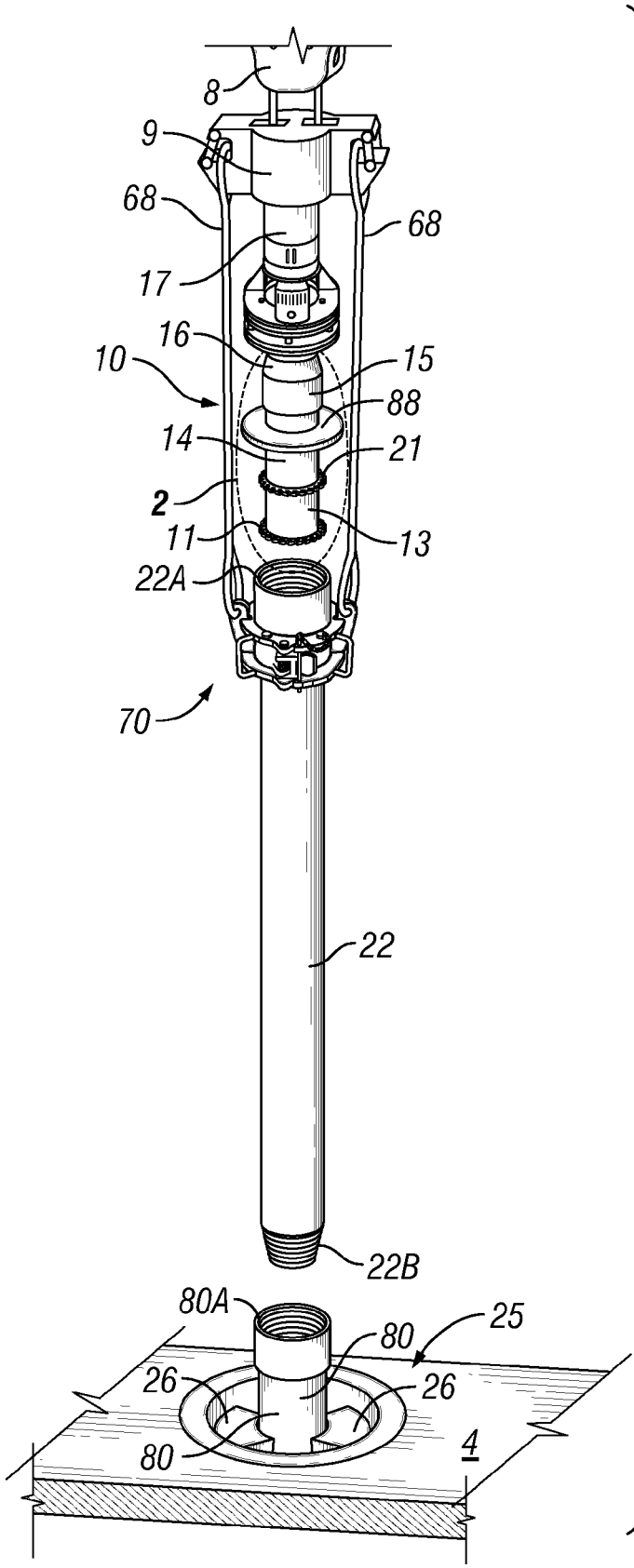
FIG. 1 is a perspective view of one embodiment of the sprag tool of the present invention rotatably supported above a rig floor by a top drive assembly and generally aligned with the bore of an add-on pipe segment supported by an elevator and positioned to be threadably coupled to a pipe string.

FIG. 1 is a perspective view of one embodiment of the sprag tool 10 of the present invention rotatably supported above a rig floor 4 by a top drive assembly 17 and generally aligned with the bore of an add-on pipe segment 22 supported by an elevator 70 and positioned to be threadably coupled to a pipe string 80. The add-on pipe segment 22 is supported from the top drive assembly 17 using a collar ring 9 and a pair of bails 68. The add-on pipe segment 22 comprises an upper end 22A having an internally threaded sleeve and a lower end 22B having external threads for being received and threadably coupled to the proximal end 80A of the pipe string 80. The pipe string 80 is supported from the rig using a spider 25 having a set of slips 26 that cooperate to grip and suspend the pipe string within a borehole (not shown).

Figure 2:
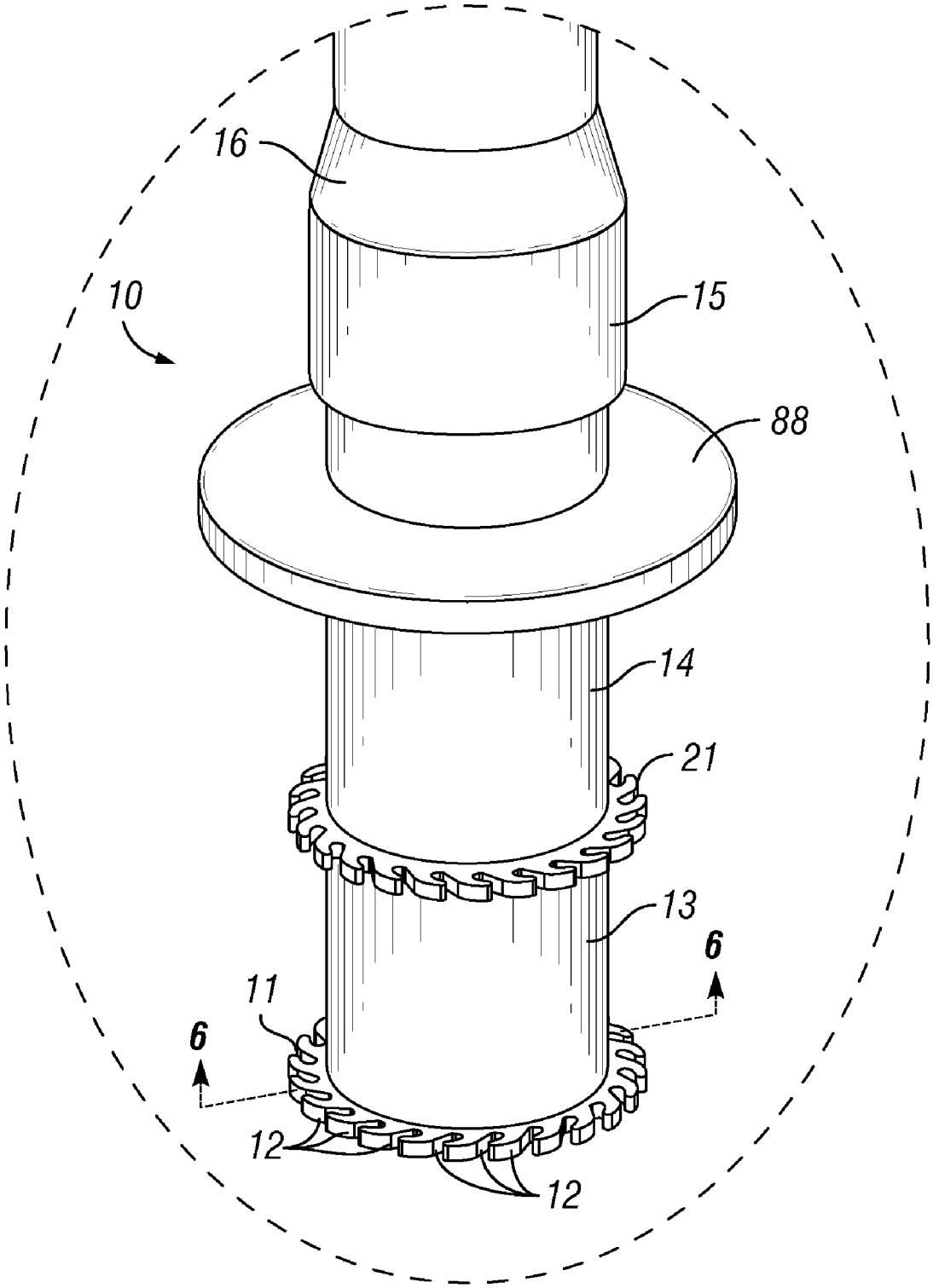
FIG. 2 is an enlarged perspective view of the sprag tool of FIG. 1 comprising two arrangements of sprags, each arrangement comprising a generally angularly distributed plurality of sprags supported on the exterior surface of a generally cylindrical sprag support.

FIG. 2 is an enlarged perspective view of the sprag tool shown in FIG. 1 comprising an upper arrangement 21 and a lower arrangement 11 of sprags, each arrangement comprising a generally angularly distributed plurality of sprags 12 supported on the exterior surface of a generally cylindrical sprag support 13. The lower arrangement 11 is positioned on the sprag support 13 a sufficient distance below the upper arrangement 21 so that the lower arrangement can be inserted into the bore of the add-on pipe segment 22 without engaging the upper arrangement 21 with the add-on pipe segment 22. A stop plate 88 may be included to limit the extent to which the sprag tool 10 can be inserted into the bore of the add-on pipe segment 22.

In the embodiment shown in FIG. 2, each sprag 12 is shown extending radially outwardly from the generally cylindrical sprag support 13, and each sprag 12 is comprised of an elastomeric material, such as rubber or polyurethane. The sprags 12 are resilient and may be deformable in multiple modes without excessive failure. The sprag tool 10 shown in FIG. 2 is adapted for being inserted within the bore of pipe having a diameter that is substantially larger than the diameter of the sprag support 13.

The shape of each elastomeric sprag 12 provides for its ratchet-type function. For example, the lower arrangement 11 comprises a generally angularly distributed plurality of sprags 12, when inserted into the bore of the add-on pipe segment 22 along with the sprag support 13 will conform to the annulus between the interior wall of the add-on pipe segment 22 and the sprag support 13. As will be discussed in more detail below, the sprags 12 are shaped such that they will permit rotation of the sprag tool 10 within the bore of the add-on pipe segment 22 in a first direction, but not in the second, opposite direction.

This sprag tool may have outwardly protruding sprags arranged on and secured to the exterior surface of a sprag support like those shown in the appended drawings, or it may comprise inwardly protruding sprags arranged on and secured to the interior surface of a larger pipe, such as a 24-inch pipe, to engage and grip the outside of a smaller pipe, such as a 20-inch pipe.

Figure 3:
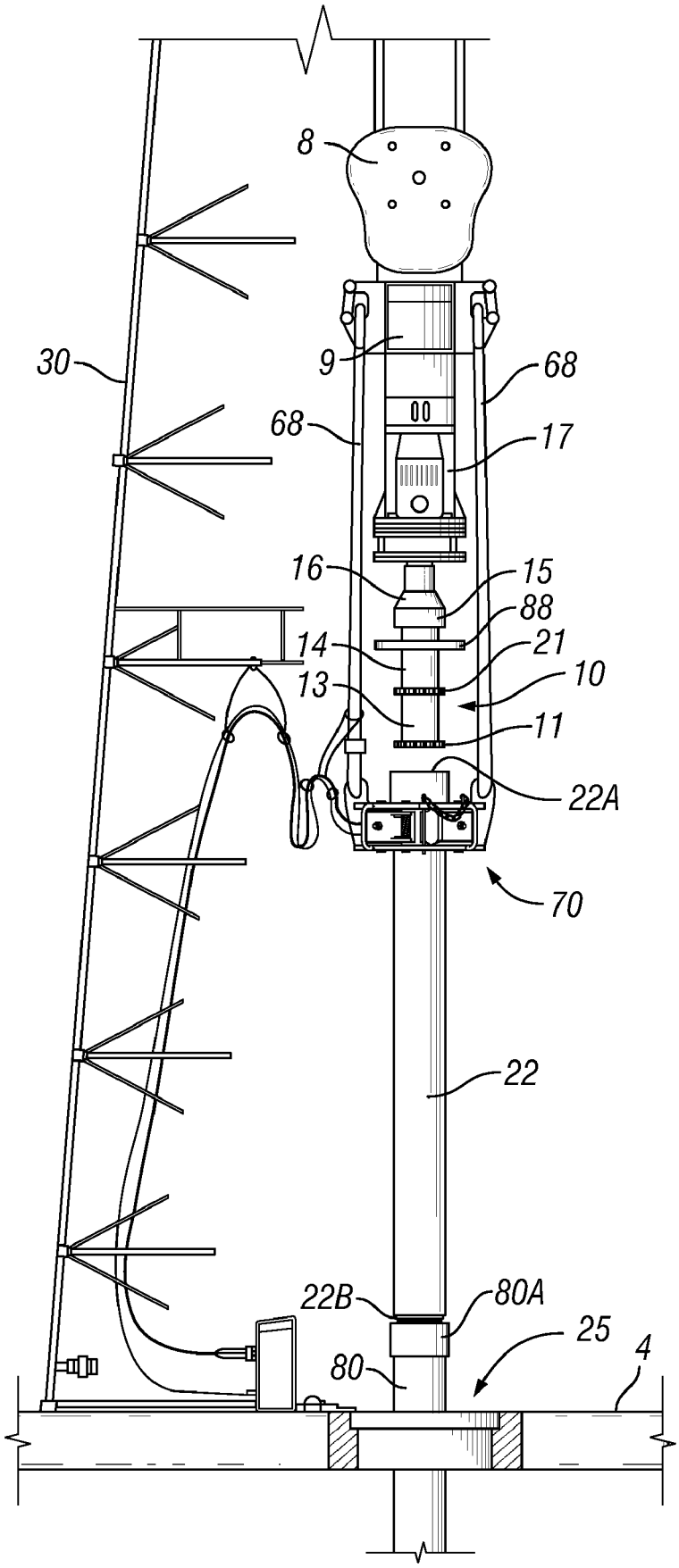
FIG. 3 is an elevation view of a top drive assembly for supporting the sprag tool of FIGS. 1 and 2 in a position generally aligned with the bore of an add-on pipe segment suspended from the top drive assembly using an elevator supported by a pair of bails. The lower end of add-on pipe segment is received into and bears against the proximal end of a pipe string that is supported from the rig by a spider.

FIG. 3 is an elevation view of a top drive assembly 17 for supporting the sprag tool 10 of FIGS. 1 and 2 in a position generally aligned with the bore of an add-on pipe segment 22 suspended from the top drive assembly 17 using an elevator 70 supported by a pair of bails 68. The lower end 22B of the add-on pipe segment 22 is received into and bears against the proximal end 80A of the pipe string 80 that is supported from the rig by the spider 25. The elevator 70 is of the type that engages and supports the shoulder formed between the lower end of the sleeve 22A and the pipe segment 22 and is adapted for sliding along at least a portion of the length of the pipe segment 22 when the add-on pipe segment 22 is supported to unload the elevator 70, as in FIG. 3. Lowering of the top drive assembly 17, including the collar ring 9, the bails 68 and the elevator 70 from its position shown in FIG. 3 will slide the elevator 70 downwardly along at least a portion of the length of the add-on pipe segment 22 and insert the sprag tool 10 into the bore of the add-on pipe segment 22.

Figure 4:
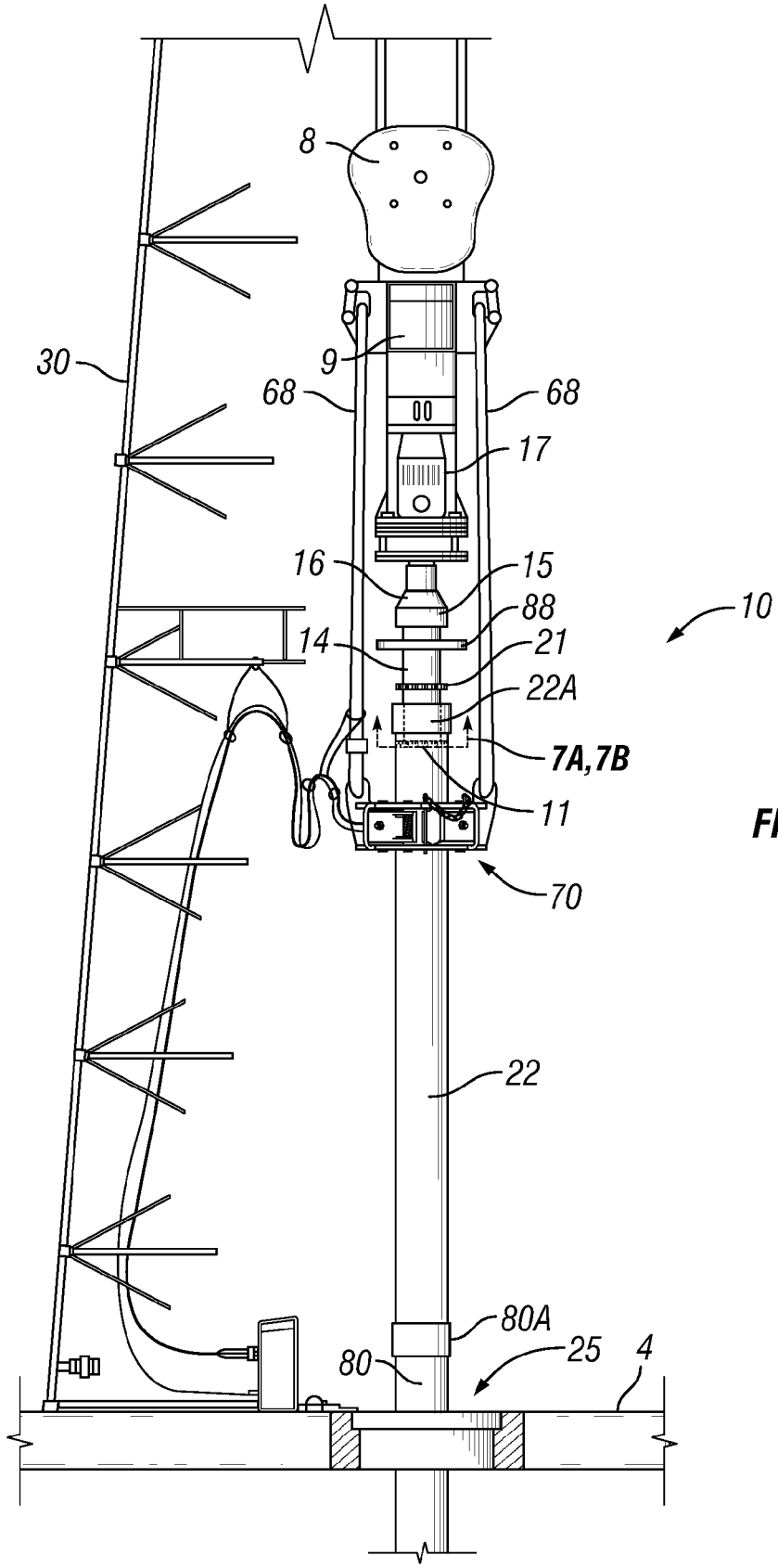
FIG. 4 is the elevation view of FIG. 3 after the lower portion of the sprag tool comprising the first arrangement of sprags is lowered and inserted into the bore of the add-on pipe segment at its upper end as the elevator slid downwardly along at least a portion of the length of the add-on pipe segment, and after the sprag tool is rotated about its axis to partially make-up the threaded connection between the add-on pipe segment and the pipe string.

FIG. 4 is the elevation view of FIG. 3 after the traveling block 8 are used to lower the top drive assembly 17, including the collar ring 9, bails 68 and the elevator 70, to partially insert the sprag tool 10 of the present invention into the aligned bore of the add-on pipe segment 22 and slide the elevator 70 along at least a portion of the length of the add-on pipe segment 22 from its upper end 22A. FIG. 4 shows that the lower arrangement 11 is inserted into the bore of the add-on pipe segment 22 through its upper end 22A, and both the upper arrangement 21 and the stop plate 88 remain above the bore of the add-on pipe segment 22. The sprag tool 10 has also been rotated after insertion into the bore of the add-on pipe segment 22 to threadably make up the connection between the lower end 22B of the add-on pipe segment 22 and the upper end 22A of the pipe string 80 to lengthen the pipe string 80. The lengthened pipe string 80 can be lifted by raising the traveling block 8, withdrawing the sprag tool 10 from the bore of the add-on pipe segment 22, and reengaging the elevator 70 with the shoulder between the proximal end 22A of the add-on pipe segment 22, then by continuing to raise the traveling block 8 to lift the lengthened pipe string 80 and unload the spider 25 so that the lengthened pipe string 80 can be lowered further into the borehole (not shown) to position the upper end 22A of the add-on pipe segment 22 for joining an additional add-on pipe segment 22.

Figure 5:
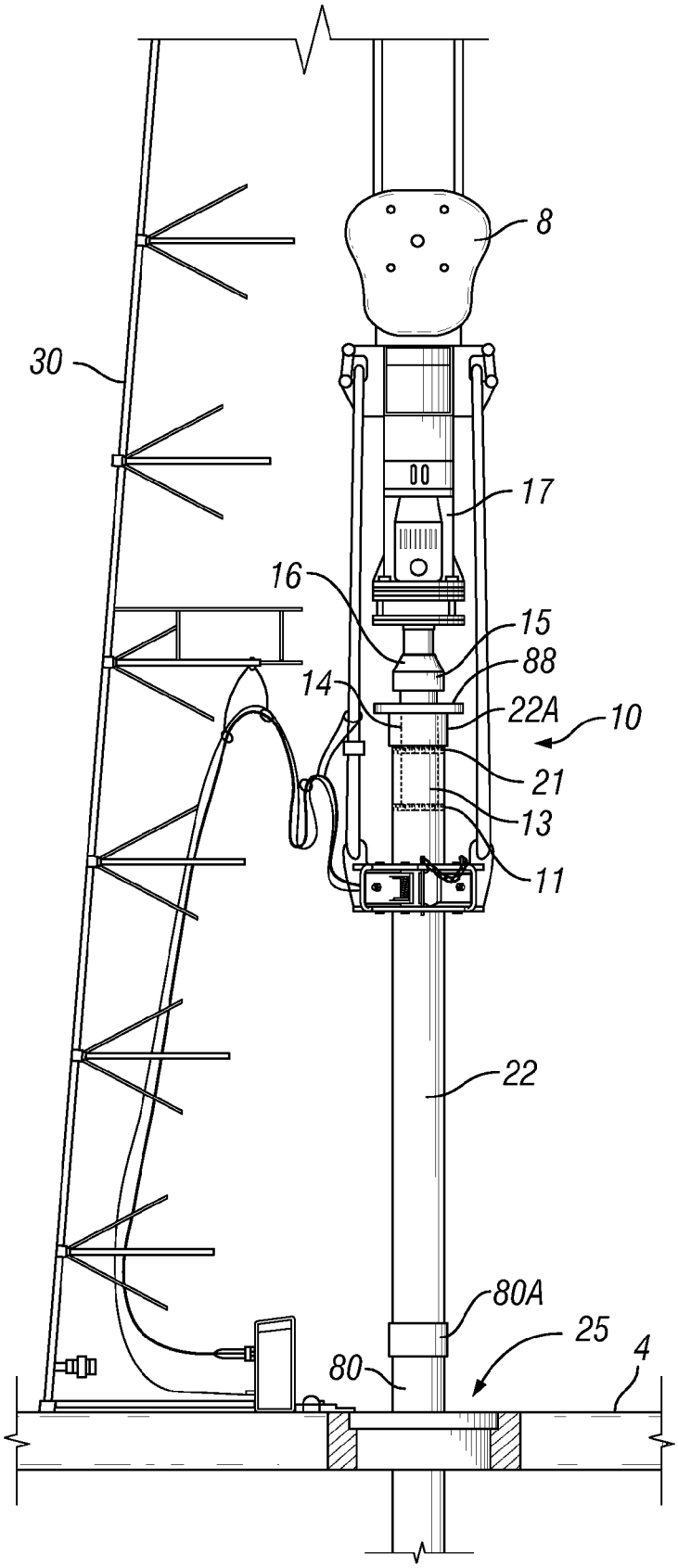
FIG. 5 is the elevation view of FIG. 4 after the second portion of the sprag tool comprising the second arrangement of sprags is inserted into the bore of the add-on pipe segment.

FIG. 5 is the elevation view of FIG. 4 after a greater portion of the sprag tool 10 comprising both the lower arrangement 11 and the upper arrangement 21 of sprags is inserted into the bore of the add-on pipe segment 22. The insertion of the greater portion of the sprag tool 10 comprising both the lower arrangement 11 and the upper arrangement 21 of sprags 12 into the bore of the add-on pipe segment 22 enables rotation of the add-on pipe segment 22 about its axis in either direction if the sprags 12 that comprise the upper arrangement 21 are reversed from their orientation within the lower arrangement 11. In the event of a need to break out a threaded connection between the add-on pipe segment 22 and the pipe string 80, simply lowering the traveling block 8 and the sprag support 13 further into the bore of the add-on pipe segment 22 until the upper arrangement 21 of sprags 12 enters the bore, and rotating the sprag support 13 in the reverse direction from that which causes the lower arrangement 11 of sprags 12 to grip, will cause the upper arrangement 21 of sprags 12 to grip the interior wall of the add-on pipe segment 22 and rotate the add-on pipe segment to break out the threaded connection. While the lower arrangement 11 is predisposed to slip within the bore of the add-on pipe segment upon rotation in a first direction, the upper arrangement 21 of sprags 12 is reversed from the lower arrangement 11, and will grip and rotate the add-on pipe segment 22 whereas slipping would have otherwise been permitted by the lower arrangement 11. Accordingly, a sprag tool 10 such as that shown in FIG. 5 having two or more spaced-apart arrangements of sprags—one arrangement reversed relative to the other—enables easy switching of modes from make up to break out.

Figure 6:
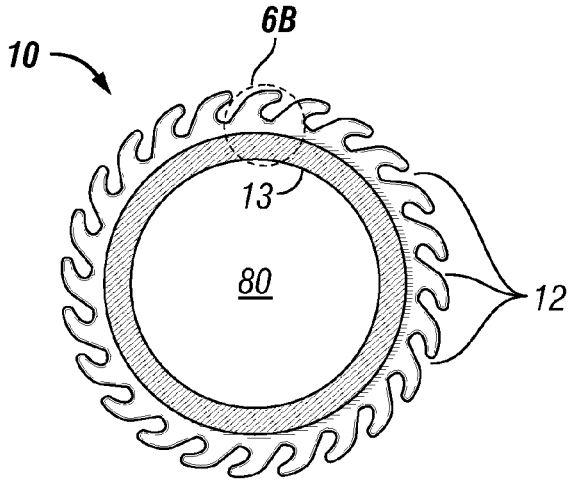
FIG. 6 is a top cross-sectional view of the sprag tool of FIG. 2 showing the arrangement of relaxed sprags supported on the sprag support before insertion of the sprag tool into the bore of the add-on pipe segment.
Figure 6A:
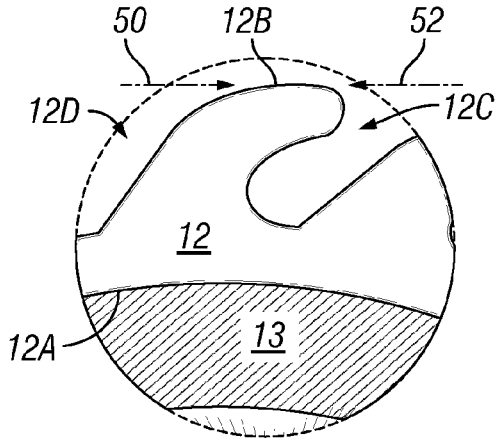
FIG. 6A is an enlarged view of one embodiment of a sprag 12 in its generally relaxed configuration.

FIG. 6 is a top cross-sectional view of the sprag tool 10 of FIG. 2 revealing the shape and profile of the lower arrangement 11 of relaxed sprags 12 supported on the sprag support 13 prior to insertion of the sprag tool 10 into the bore of the add-on pipe segment 22. The sprags 12 are arranged in a ring that is generally shaped like a ripping blade for a circular saw. FIG. 6A is an enlarged view of one embodiment of a sprag 12 that may be used on the sprag tool of FIG. 6. The sprag 12 in FIG. 6A is shown in a relaxed configuration. As shown in FIG. 6A, each sprag 12 generally comprises a base 12A, a top portion 12B, an interrupted side 12C and a substantially uninterrupted side 12D. The sprag 12 is secured at its base 12A to the sprag support 13. The base 12A is secured to the sprag support 13 and the top portion 12B extends generally radially away from the base 12A. The interrupted side 12C comprises a large recess, gap or void portion in the sprag 12 that allows the sprag 12 to lean, fold or collapse in response to a force applied laterally to the sprag 12 near the top portion 12B and generally along the direction of the arrow 50. The substantially uninterrupted side 12D of the sprag 12 is generally opposite the interrupted side 12C and is structured to resist leaning, folding or collapsing in response to a force applied laterally to the sprag 12 near the top portion 12B and generally along the direction of the arrow 52.

Figure 7A:
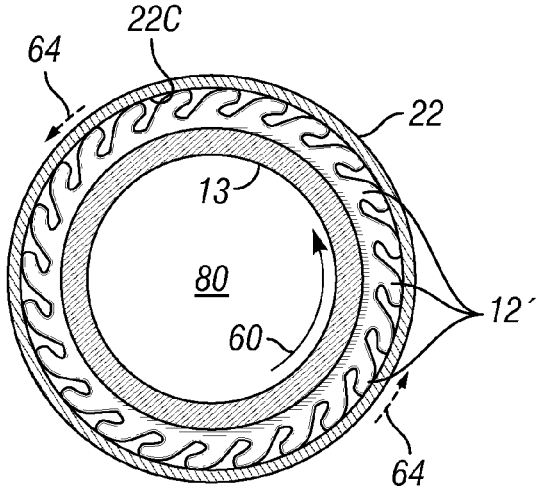
FIG. 7A is a cross-sectional view of FIG. 6 as the sprag tool is inserted into the bore of the add-on pipe segment and rotated by the top drive in the direction of the arrow 60. The sprags are shown deformed toward the complaint configuration to slide along the interior wall of the add-on pipe segment upon rotation of the sprag tool.
Figure 7B:
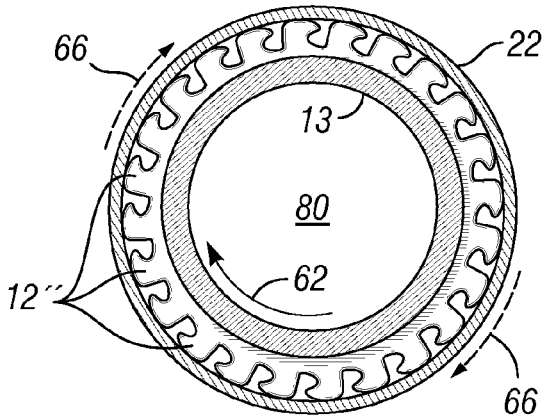
FIG. 7B is the cross-section view of FIG. 7A as the sprag tool is rotated by the top drive in the direction of the arrow 62. The sprags are shown deformed toward their non-compliant configuration to grip the interior wall of the add-on pipe segment.

The two distinct modes of deformation of the sprag 12 described in relation to FIG. 6A are illustrated in FIGS. 7A and 7B. FIG. 7A is a cross-sectional view of the lower arrangement 11 of deformed sprags 12' shown in FIG. 6 after the sprag tool 10 inserted into the bore of the add-on pipe segment 22 and the sprag support 13 is rotated by the top drive assembly 17 in the direction of the arrow 60. The deformed sprags 12' are shown to be compliantly deformed, each by a force applied by the interior wall 22C of the add-on pipe segment 22 and in the direction shown by the arrow 50 in FIG. 6A. The leaned, folded or collapsed sprag 12' slides along the interior wall 22C of the add-on pipe segment 22 during rotation of the sprag support 13 in the direction of arrow 60. Each deformed sprag 12' imparts minimal friction to the interior wall 22C because there is little force imparted by each deformed sprag 12' to the interior wall 22C. The resulting rotational torque applied by the leaning, folded or collapsed sprags 12' to the add-on pipe segment 22 is illustrated by the direction and length of arrows 64.

It should be noted that there are a variety of sprag shapes that may provide the ratchet-like function of the sprag tool. The shape of the sprag, in additional to its elastomeric properties, provides for its ratchet-like function in the present invention. One embodiment of a sprag used on a tool of the present invention comprises a base for being secured to a sprag support, a top of the sprag generally opposite the base for contacting the wall of an add-on pipe segment, and two sides generally intermediate the base and the top of the sprag. The sprag is generally flexible to enable it to be placed into an annular space between the sprag support and the wall of an add-on pipe segment.

One side of the sprag is generally interrupted to allow the sprag to lean, fold or generally collapse when a generally lateral force is applied by movement of sprag support relative to the contacted wall of the add-on pipe segment, near the top of the sprag, and in the direction toward the generally interrupted side of the sprag. The leaning, folding or collapsing of each sprag in response to the lateral force applied as a result of movement of the sprag tool relative to the wall of the add-on pipe segment results in relatively little force applied by the sprag to the wall of the add-on pipe segment and, as a result, little frictional resistance to sliding movement of the wall of the add-on pipe segment relative to the sprag. It should be appreciated that the frictional force applied by the sprag to resist relative movement of the wall of the add-on pipe segment is a function of the force applied by the sprag to the wall, the area of contact between the sprag and the wall, and the coefficient of friction between the sprag material and the wall.

FIG. 7B is the cross-section view of the lower arrangement 11 of deformed sprags 12" shown in FIG. 6 after the sprag tool 10 inserted into the bore of the add-on pipe segment 22 and the sprag support 13 is rotated by the top drive assembly 17 in the direction of the arrow 62. The deformed sprags 12" are shown to be deformed to a generally non-compliant configuration, each by a force applied by the interior wall 22C of the add-on pipe segment 22 and in the direction shown by the arrow 52 in FIG. 6A. The generally collapse-resistant sprag 12" bends to a configuration that compresses between the interior wall 22C of the add-on pipe segment 22 during rotation of the sprag support 13 in the direction of arrow 62. Each non-compliant and compressibly deformed sprag 12" imparts substantial friction to the interior wall 22C because there is a great force imparted by each compressibly deformed sprag 12" to the interior wall 22C. The resulting rotational torque applied by the sprags 12" to the add-on pipe segment 22 is illustrated by the direction and length of arrows 66.

The embodiment of the sprag tool 10 shown in the appended drawings is rotatably suspended from a rotatable quill of a top drive assembly 17, and positionable above and alignable with a pipe string 80 suspended in a borehole (not shown) using a spider 25. It should be understood that any tool that provides for supporting and rotating the sprag tool 10 may be substituted without loss of function.

It should be understood that the capacity of a sprag tool to impart torque to an add-on pipe segment may vary according to the number, size and shape of the sprags. Also, additional torquing capacity may be achieved by including multiple rows or rings of sprags within an arrangement. For example, an arrangement of sprags resembling those shown in the lower arrangement 11 in FIG. 2 that were secured on the exterior surface of a 16-inch cylindrical support produced 4,200 ft-lbs of torque on a 20-inch add-on pipe segment when the sprag tool was inserted into the bore of the add-on pipe segment and rotated using a simulated top drive. This amount of torque may be readily doubled by securing two adjacent rows or rings of sprags into a single arrangement. In this manner, unless the add-on pipe segment is somehow obstructed or is extremely short, almost any reasonable torque may be attained using a sprag tool of the present invention.

The terms "comprising," "including," and "having," as used in the claims and specification herein, indicate an open group that includes other elements or features not specified. The term "consisting essentially of," as used in the claims and specification herein, indicates a partially open group that includes other elements not specified, so long as those other elements or features do not materially alter the basic and novel characteristics of the claimed invention. The terms "a," "an" and the singular forms of words include the plural form of the same words, and the terms mean that one or more of something is provided. The terms "at least one" and "one or more" are used interchangeably.

The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

I claim:

1. A system to rotate a pipe segment comprising:

a top drive movable on a rig along an axis;

a sprag support coupled to the top drive to move therewith;

at least one flexible primary sprag comprising a base secured to the sprag support, a top generally opposite the base to engage a wall of the pipe segment, and an interrupted side and an opposite side intermediate the top and the base;

wherein the sprag support is receivable at least one of within a bore of and about the end of the pipe segment to engage the top of the at least one primary sprag with the wall of the pipe segment;

wherein rotation of the sprag support in a first direction applies a force to the top of the at least one primary sprag toward the interrupted side to facilitate slippage between the wall and the at least one primary sprag; and wherein rotation of the sprag support in a second direction opposite the first direction applies a force to the top of the at least one primary sprag to cause the at least one primary sprag to grip and rotate the pipe segment with the sprag support.

2. The system of claim 1 wherein the at least one primary sprag is sized to be receivable in an annulus between the sprag support and the wall of the pipe segment in an interference fit.

3. The system of claim 1 wherein the at least one primary sprag comprises an elastomeric material.

4. The system of claim 1 wherein the sprag support is tubular and the at least one primary sprag is secured to an interior wall of the tubular sprag support.

5. The system of claim 1 wherein the sprag support is coupled to a quill of the top drive.

6. The system of claim 1 wherein the top of the at least one sprag comprises an elastomeric material at an engagement point with the wall of the pipe segment.

7. The system of claim 1 wherein the opposite side of the primary sprag comprises at least one of a gap, a recess, a hole, a notch, a void, and a combination of these features, to permit the sprag to at least one of compliantly lean, fold and collapse in response to the application of a generally lateral force near the top of the primary sprag and in the direction of the generally interrupted side.

8. A system to rotate a pipe segment to threadably couple the pipe segment to a pipe string, comprising:

a top drive movable on a rig along an axis;

a sprag support coupled to the top drive to move therewith;

at least one flexible primary sprag secured to the sprag support at a base, the primary sprag comprising a top generally opposite the base to engage a wall of the pipe segment; and at least one oppositely-oriented, flexible secondary sprag secured to the sprag support along a base of the secondary sprag and at a location on the sprag support apart from the at least one primary sprag.

9. The system of claim 8 wherein a plurality of angularly distributed primary sprags are spaced apart from a plurality of angularly distributed secondary sprags.

10. The system of claim 9 wherein the plurality of primary sprags are secured to the sprag support in a first arrangement that is generally circumferential.

11. The system of claim 10 wherein the plurality of angularly distributed secondary sprags are secured to the sprag support in a second arrangement that is generally circumferential.

12. The system of claim 8 wherein the at least one secondary sprag is disposed intermediate the at least one primary sprag and the top drive.

13. The system of claim 8 wherein the tool is receivable within a bore of the pipe segment to engage the at least one primary sprag with the wall of the pipe segment;

wherein the wall is an interior wall.

14. The system of claim 8 wherein the tool is receivable over the end of the pipe segment to engage the at least one primary sprag with the wall of the pipe segment;

wherein the wall is an exterior wall.

15. The system of claim 8 wherein the at least one oppositely-oriented, secondary sprag comprises an interrupted side and a generally opposite side, the sides being generally intermediate the base and the top;

wherein the at least one secondary sprag compliantly collapses toward the interrupted side in response to a lateral force applied to the top of the sprag by the wall of the pipe segment upon rotation of the sprag support about the axis in a first direction, and the primary sprag resists collapse in response to a force applied to the top of the sprags by the wall of the pipe segment upon rotation of the sprag support in a second and opposite direction.

16. A system to threadably make up a connection between a pipe segment and a pipe string suspended within a borehole, comprising:

a sprag support releasably connectable to a top drive on a rig to move therewith;

at least one flexible sprag having a top to engage a wall of the pipe segment, a base secured to the sprag support, and an interrupted side and an opposite side, both intermediate the top and the base;

wherein the sprag collapses to slip on the pipe segment in response to an applied force at the top of the at least one sprag and directed to the interrupted side; and wherein the sprag compresses to grip the pipe segment in response to an applied force at the top of the at least one sprag and directed to the opposite side.

17. The system of claim 16 wherein the at least one sprag comprises an elastomeric material.

18. The system of claim 16 wherein the at least one sprag comprises a plurality of sprags angularly distributed about the sprag support.

19. The system of claim 16 wherein the sprag support and the at least one sprag is receivable within a bore of the pipe segment to engage the top of the at least one sprag with an interior wall of the pipe segment.

20. The system of claim 16 wherein the sprag support comprises a tubular receivable over the end of the pipe segment to engage the top of the at least one primary sprag with an exterior wall of the pipe segment.

21. A system to threadably make up a connection between a pipe segment and a pipe string suspended within a borehole, comprising:

a top drive movable on a rig along an axis generally aligned with the pipe string;

a sprag support coupled to the top drive to move therewith;

a plurality of sprags having a top and a base secured to and angularly distributed about the sprag support; and at least one oppositely-oriented secondary sprag secured to the sprag support along the base at a location on the sprag support apart from the plurality of sprags.

22. The system of claim 21 wherein the at least one sprag is secured to an exterior wall of the sprag support.

23. The system of claim 21 wherein the sprag support is tubular and the at least one sprag is secured to an interior wall of the tubular sprag support.

24. The system of claim 21 wherein the at least one secondary sprag comprises an interrupted side and an opposite, side, the sides being generally intermediate the base and the top;

wherein the at least one secondary sprag compliantly collapses toward the interrupted side in response to a force applied to the top of the at least one secondary sprag by the wall of the pipe segment upon rotation of the sprag support about the axis in a first direction, and the at least one secondary sprag resists collapse in response to a lateral force applied to the top of the at least one secondary sprag by the wall of the pipe segment upon rotation of the sprag support in a second direction.

25. The system of claim 21 wherein at least some of the sprags are circumferentially arranged on the sprag support.

26. The system of claim 21 wherein the sprag support is coupled to a quill of the top drive.

27. A system to threadably make up a connection between a pipe segment and a pipe string suspended within a borehole, comprising:

a top drive movable on a rig along an axis generally aligned with the pipe string;

a sprag support coupled to the top drive to move therewith; and at least one sprag having a top and a base secured to the sprag support;

wherein the at least one sprag is secured to a band that is secured to the sprag support.

28. A method of making-up or breaking-out a pipe segment into a pipe string comprising the steps of:

providing at least one primary sprag secured along a base to a sprag support and having a top opposite the base to engage a wall of the pipe segment, an interrupted side intermediate the top and the base and an opposite side intermediate the top and the base;

coupling the sprag support to a top drive movable along an axis on a rig;

positioning an end of the pipe segment proximate an end of the pipe string;

moving the sprag support along the axis;

engaging the wall of the pipe segment with the at least one primary sprag; and rotating the sprag support in a first direction using the top drive to rotate the pipe segment relative to the pipe string to threadably couple the pipe segment to the pipe string.

29. The method of claim 28 wherein the engaging step comprises contacting the wall with the at least one primary sprag;

wherein the wall is an interior wall.

30. The method of claim 28 wherein the engaging step comprises contacting the wall with the at least one primary sprag;

wherein the wall is an exterior wall.

31. The method of claim 28 wherein rotation of the sprag support causes the at least one primary sprag to collapse to impart substantially less frictional force to the wall of the pipe segment engaged by the top of the at least one primary sprag as compared to the frictional force imparted to the wall of the pipe segment by the at least one primary sprag upon rotation of the sprag support in the opposite direction.

32. The method of claim 28 wherein the primary sprags comprise an elastomer.

33. The method of claim 28 wherein the sprag support is coupled to a quill of the top drive.

34. A non-marking method of making-up or breaking-out a pipe segment into a pipe string comprising the steps of:

providing at least one primary sprag secured to a sprag support;

coupling the sprag support to a top drive movable along an axis on a rig;

positioning an end of the pipe segment proximate an end of the pipe string supported within a borehole by the rig;

moving the sprag support along the axis;

engaging a wall of the pipe segment with the at least one primary sprag;

rotating the sprag support with the top drive to rotate the pipe segment relative to the pipe string to threadably couple the pipe segment to the pipe string;

providing at least one oppositely-oriented secondary sprag secured to the sprag support;

moving the sprag support along an axis of the pipe segment to engage the wall of the pipe segment with the at least one oppositely-oriented secondary sprag;

rotating the sprag support to rotate the pipe segment relative to the pipe string; and threadably decoupling the pipe segment from the pipe string.

35. The method of claim 34 wherein the secondary sprags comprise a top and a base, and an interrupted side and an opposite side intermediate the base and the top.

36. The method of claim 34 further comprising the step of coupling the sprag support to a quill of the top drive.

37. A method of applying torque to a pipe segment to make up a threaded connection between the pipe segment and an aligned pipe string comprising the steps of:

providing a plurality of sprags secured along a base to a sprag support, the plurality of sprags having a top opposite the base to engage the pipe segment, an interrupted side intermediate the top and the base, and an opposite side intermediate the top and the base;

coupling the sprag support to a top drive on a rig;

receiving at least a portion of the sprag support at least one of within a bore of the pipe segment and about an end of the pipe segment to engage the sprags with the pipe segment; and rotating the sprag support in a first direction to grip and rotate the pipe segment with the top drive through the sprags.

38. The method of claim 37 wherein the step of providing a plurality of sprags comprises providing three or more sprags.

39. The method of claim 37 wherein the step of coupling the sprag support to a top drive on a rig comprises releasably coupling the sprag support to the quill of a top drive.

* * * * *